US006273922B1

(12) United States Patent
Funk et al.

(10) Patent No.: US 6,273,922 B1
(45) Date of Patent: Aug. 14, 2001

(54) DURABLE BRIQUETTES FOR USE IN GAS-FIRED BARBECUE GRILLS

(75) Inventors: John R. Funk; Hilton A. Dickson, III, both of Las Cruces, NM (US)

(73) Assignee: Sante Fe Thermal Products, LLC, Las Cruces, NM (US)

( * ) Notice: Subject to any disclaimer, the term of this patent is extended or adjusted under 35 U.S.C. 154(b) by 0 days.

(21) Appl. No.: 09/606,662

(22) Filed: Jun. 28, 2000

Related U.S. Application Data

(60) Provisional application No. 60/176,264, filed on Jan. 14, 2000.

(51) Int. Cl.[7] ..... C10L 5/00

(52) U.S. Cl. ..... 44/577; 44/580; 44/590; 44/593; 44/596; 44/628

(58) Field of Search ..... 44/577, 580, 590, 44/593, 596, 598, 628

(56) References Cited

U.S. PATENT DOCUMENTS

| | | | |
|---|---|---|---|
| 741,493 | 10/1903 | Von Heydebrand . | |
| 850,232 | 4/1907 | Kline . | |
| 1,481,942 | 1/1924 | Vogel . | |
| 2,341,377 | 2/1944 | Hinderer | 44/15 |
| 2,822,251 | 2/1958 | Swinehart et al. | 44/41 |
| 3,492,134 | 1/1970 | Brummendorf | 99/229 |
| 3,613,657 | 10/1971 | Wilska et al. | 126/41 R |
| 4,058,052 | 11/1977 | Hart | 99/646 R |
| 4,102,653 | 7/1978 | Simmons et al. | 44/16 R |
| 4,277,358 * | 7/1981 | Farcnik | 252/62 |
| 4,787,914 | 11/1988 | Crace | 44/16 A |
| 4,857,074 | 8/1989 | Crace | 44/540 |
| 5,096,727 | 3/1992 | Crace | 426/314 |
| 5,105,725 * | 4/1992 | Haglund | 99/446 |
| 5,427,805 | 6/1995 | Crace | 426/314 |

* cited by examiner

*Primary Examiner*—Margaret Medley
(74) *Attorney, Agent, or Firm*—Rod D. Baker

(57) ABSTRACT

A briquette, and method of making it, for use in gas-fired barbecue grills. The briquette features three desirable characteristics: (1) relative permanency or durability, i.e. it is useable a number of times without physical disintegration or shedding of ash; (2) the desirable heat absorption and radiation characteristics of lava rock; and (3) the ability to impart flavor to the grilled food.

Broadly described, the briquette includes from about 60 percent to about 95 percent by weight lava rock fines such as scoria or basalt fines, from about 5 percent to about 15 percent by weight calcium aluminate and/or Portland cement, less than 5 percent by weight starch; and—before drying in manufacture—from about 0.2 percent to about 8 percent by weight water. Ideally, the briquette also includes up to about 10 percent by weight wood particles such as hickory or mesquite shavings.

A method for making the inventive briquette is disclosed.

30 Claims, No Drawings

DURABLE BRIQUETTES FOR USE IN GAS-FIRED BARBECUE GRILLS

CROSS-REFERENCE TO RELATED APPLICATIONS

This application claims the benefit of the filing of U.S. Provisional Patent Application Ser. No. 60/176,264, entitled Briquettes for Cooking Grills, filed on Jan. 14, 2000, and the specification thereof is incorporated herein by reference.

BACKGROUND OF THE INVENTION

1. Field of the Invention (Technical Field)

The present invention relates to briquettes for use with barbecue cooking grills, particularly to briquettes for use with gas-fired grills.

2. Background Art

Recreational cooking on outdoor grills is rapidly increasing in popularity. Outdoor grilling, often called "barbecuing," involves the use of a heat source that cooks the food, and that preferably also imparts a grilled or "barbecue" flavor to the food. Outdoor cooking grills historically have used pre-formed charcoal briquettes, or wood coals from a hot fire, as a heat source. A disadvantage of conventional pre-formed charcoal briquettes or wood coals is the length of time required to heat the charcoal or coals to sufficient grilling temperature. Further, standard charcoal briquettes tend to "shed" or break apart, which renders them unsuitable for use in modern gas-fired grills, as explained in U.S. Pat. No. 4,787,914 to Crace.

Modern alternatives to historical cooking grills are gas and electric grills, which can obtain cooking temperature in a comparatively shorter time. The naked flame of a propane gas or other gas grill, however, often is an uneven or variable source of heat, sometimes resulting in less than satisfactory barbecuing results. In an effort to ameliorate the problem of uneven cooking, permanent or semi-permanent briquette substitutes, usually consisting of either naturally occurring lava-type stones or cemented clay briquettes, frequently are used with gas grills. Basalt cobbles or cemented clay briquettes promote uniform, consistent, heating of the food over a period of time. The gas-generated flame heats the rock or cement briquettes, which then in cooperation with the gas flame cook the food. As the food cooks, juices from the foods may fall upon the heated rocks or cement briquettes. The flavoring compounds in the juices are volatilized from the rocks or briquettes and are absorbed into the grilled foods. Known semi-permanent briquettes for use in gas fired grills commonly are composed of Portland cement, with various types of small aggregate. These semi-permanent briquettes tend to break down after several, sometimes numerous, uses, but offer the advantage of allowing admixtures (such as hickory chips, liquid flavorizing agents) with the briquette at the time of manufacture. Wood chips promote "flavorization" of the grilled food.

Natural lava rock cobbles or stones also are used in lieu of man-made briquettes. Lava cobbles (e.g. anywhere from about 2.5 cm to about 10.0 cm or even 15.0 cm mean diameter) are desired for their durability. Lava rock repeatedly absorbs and radiates large amounts of heat energy over many cooking cycles before breaking down. Also, lava rock generally absorbs and re-radiates thermal energy in a desirably uniform manner, compared to many other types of solids. But natural lava rock cobbles do not admit the use of admixtures such as wood chips or other flavorizers, and thus inhibit the chefs efforts to impart a "barbeque" flavor to the food.

Although gas and electric grills are extremely convenient in terms of preparation time, the rocks or cement briquettes, unlike conventional briquettes made from charcoal, do not impart a natural "smoked" or wood barbeque flavor to the food being cooked. Rather, any additional flavor is dependent upon the food itself, as juices drop onto the hot briquettes.

In U.S. Pat. No. 4,058,052, to Hart, aluminum briquettes having liquid retaining channels are described, which allow fat and juices of the food to form a char on the surface of the briquettes so as to transmit flavored vapors to the food being cooked. Unfortunately, the char layer is often difficult to produce and the amount and choice of flavor transmitted to the food is difficult to control. U.S. Pat. No. 4,857,074, to Crace, discloses the use of a noncombustible, permanent briquette saturated with a liquid smoke composition. As the gas or electric grill heats the briquettes, the liquid smoke is volatilized, and flavor and color from the liquid smoke are added to the grilled foods. After use, the briquettes can again be soaked with any commercially available liquid smoke composition and used as before. Unfortunately, the liquid smoke is a less-desirable substitute for genuine wood-flavored barbecue.

U.S. Pat. No. 2,341,377 to Hinderer, and U.S. Pat. No. 5,427,805 to Crace, suggest the inclusion of wood pellets or chips within artificially molded briquettes so that the pellets release aromatic flavoring particles when burned. U.S. Pat. Nos. 4,787,914 and 5,096,727 to Crace, are illustrative of other previous attempts to develop suitable briquettes for use in barbecue grilling. U.S. Pat. No. 4,102,653 to Simmons et al. also is instructive as to the state of barbecue grills and briquettes.

Nevertheless, there exists a need for a permanent or semi-permanent briquette that manifests all three advantages of a briquette optimally useful in electric, or especially gas-fired, grills—the advantages of durability (repeated use with minimal "shedding" or physical breakdown), uniform heating characteristics (such as that provided by lava rock), and the imparting of wood-like flavor to the food being cooked. Against this background, the present invention was developed.

SUMMARY OF THE INVENTION (DISCLOSURE OF THE INVENTION)

The present invention relates to a briquette and a method of making a briquette. The briquette is intended for use in gas-fired barbecue grills. The briquette of the invention features three desirable characteristics which are not believed to be found in any known briquette: (1) relative permanency or durability, ie. useable a number of times without physical disintegration or shedding of ash; (2) heat absorption and radiation characteristics of lava rock (efficiency and uniformity); and (3) ability to impart flavor to the grilled food (incorporation of wood particle admixtures).

Broadly described, the apparatus of the invention is a briquette, for use with a barbecue grill, comprising from about 60 percent to about 95 percent by weight lava rock fines; from about 5 percent to about 15 percent by weight calcium aluminate; less than 5 percent by weight starch; and—before drying during manufacture—from about 0.2 percent to about 8 percent by weight water. Preferably, the briquette comprises from about 80 percent to about 90 percent by weight lava rock fines and about 5 percent to about 15 percent by weight starch. The starch may be cornstarch. Preferably, before drying, the briquette comprises from about 0.5 percent to about 2 percent by weight water. Optionally, but very preferably the briquette includes up to 10 percent by weight wood particles, more preferably from between 1 percent to about 4 percent by weight wood particles, such as hickory or mesquite shavings.

The method of the invention is manufacturing a briquette for use with a barbecue grill, comprising the step of making a dough by mixing together from about 60 percent to about 95 percent by weight lava rock fines, from about 5 percent to about 15 percent by weight calcium aluminate, less than 5 percent by weight starch, and from about 0.2 percent to about 8 percent by weight water. The method comprises the further step of forming the dough into a briquette, such as by extruding and roll pressing. The method further comprises the step of drying the briquette. Preferably, step of making a dough comprises mixing from about 80 percent to about 90 percent by weight lava rock fines into the mixture. Also, the method preferably includes mixing into the dough mixture from about 5 percent to about 15 percent by weight starch. Preferably, from about 0.5 percent to about 2 percent by weight water is mixed into the dough. To provide a flavorizing admixture, less than 10 percent by weight wood particles may be added to the mixed dough. The wood particles ideally are wood shavings, rather than compressed pellets.

A primary advantage of the present invention is the provision of a barbecue briquette that is durable and capable of repeated use in a gas-fired grill without breaking down or shedding ash into the grill, and yet possesses the beneficial heat-absorbing and heat-radiating characteristics of lava rock, while also permitting the incorporation therein of wood particle admixtures as flavorizing agents.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

DESCRIPTION OF THE PREFERRED EMBODIMENTS (BEST MODES FOR CARRYING OUT THE INVENTION)

The invention relates to briquettes for use with outdoor cooking grills, especially gas-fired grills, such as those utilizing liquid propane or natural gas. There are two basic types of outdoor grills for barbecuing foods. The more traditional type involves the use of charcoal briquettes that are ignited and burn to cook the food. This invention does not have to do with such traditional types of briquettes.

Modern gas-fired grills burn propane or butane to cook the food. A different type of briquette is used (usually optionally, but desirably) with this second type of grill. Gas-fired grills use semi-permanent cement- or ceramic-type briquettes that do not burn, but rather serve to absorb and then radiate heat from the gas burner. The radiant heat from the semi-permanent briquettes provides for more even, controlled cooking. The present invention relates to this latter type of briquette, primarily for use with gas-fired barbecue grills.

The present invention, by including pre-selected volumes of crushed lava fines in the ingredients of a manufactured briquette, provides a briquette with desirable heat absorption/radiation properties, combined with durability and longevity, as well as admitting the inclusion of wood shavings or other flavorizers.

The apparatus of the invention is a man-made briquette manufactured from "lava rock fines." Lava rock fines are produced from the mechanical pulverization of lava rock. Lava rock naturally occurs as cobbles and stones, and also may be mined from lava flows in areas of geologically recent volcanic activity. "Lava rock" refers principally to cinder-like scoria, but may include basalt and similar fundamental igneous rock principally containing plagioclase. "Lava rock fines" consist of lava rock pulverized to particles of no more than about 1.0 cm, and preferably less than about 8.0 mm, mean diameter. In the process of the invention, wet lava rock fines are mixed with binders, such as calcium aluminate and starch, and then formed into briquettes, resulting in briquettes that have the advantages of lava rock, but also allow admixtures—again, such as wood particles—to be added to the briquettes. The wood chip admixtures are intended to impart better flavor and aroma to the grilled food.

One preferred, but not exclusively limiting, composition of a briquette according to the present invention includes between approximately 60 to 95% by weight, preferably between approximately 80 and 90% by weight, crushed lava or scoria fines, with particle sizes of 8.00 mm average diameter or less. Preferably, the lava rock fines are particles passing through 300-mesh screen. This embodiment also includes between approximately 5 and 40% by weight, preferably between approximately 5 and 15% by weight, Portland cement and/or calcium aluminate, and approximately 0 to 5% by weight, preferably between approximately 2 and 4% by weight, starch, preferably cornstarch, to which approximately 0.2 to 8% by weight, preferably between approximately 0.5 and 2% by weight, water has been added. Optionally but preferably, between approximately 0 to 10% by weight, or more desirably, between approximately 1 and 4% by weight, natural wood chips or particles, preferably wood shavings of common flavored woods such as hickory, mesquite, and apple, are provided as an admixture. Natural wood shavings or chips, that is, shavings that have not been mechanically pelletized or compressed, are preferred, although alternative embodiments of the invention may utilize artificially compressed wood pellets.

The amount of each ingredient within the specified formula may be modified to change tensile strength, crushing force, or flavoring characteristics of the briquette. If the optional wood particles are used, the briquettes of the present invention will be capable of sustaining emission of flavoring compounds throughout the cooking process as the food is being cooked over the flame and heated briquettes.

No particular size, shape or configuration is necessary to form the briquettes. The shape, however, is generally in the form of a common charcoal briquette, approximately 5.2-cm square in plan view by about 2.6 cm in height.

INDUSTRIAL APPLICABILITY

The briquette of the invention is further illustrated by the following non-limiting examples. The following examples also describe methods of manufacturing the crushed lava fines briquettes according to the invention. Ingredient amounts are given in percentages by weight, unless otherwise indicated.

EXAMPLE 1

Approximately 87.5% by weight of lava rock fines were mixed with calcium aluminate 10%, and starch 2%. Water, 0.5% by weight, was added to the mixture, which was then fed into a conventional briquette roll press, roll torque of 6025 Nm. The formed briquettes were then allowed to dry under ambient conditions.

Briquettes manufactured according to this method demonstrated adequate crushing strength. When "green", a briquette showed 247.8 N of crushing force, with a 2.1-m drop height at failure. After 96 hours of dry curing at ambient temperature, the crushing force was 1312.2 N.

Alternatively, the briquettes may be cured in a kiln. For example, a briquette manufactured according to the forgoing formula of this example, and cured at 800° C. for one hour, withstood 1112.0 N of crushing force.

The cured briquettes of this formula had a density of about 2.22 g/cm$^3$.

EXAMPLE 2

Approximately 86.5% by weight of lava rock fines were mixed with calcium aluminate 10%, starch 2%, and wood shavings 1%. Water, 0.5% by weight, was added to the mixture, which was then fed into a conventional briquette roll press, roll torque of 5870 Nm. The formed briquettes were then allowed to dry under ambient conditions.

Briquettes manufactured according to this method demonstrated adequate crushing strength. When "green", a briquette showed 228.6 N of crushing force, with a 2.1-m drop height at failure. After 96 hours of dry curing at ambient temperature, the crushing force was 1223.2 N.

A briquette manufactured according to the forgoing formula of this example, and cured at 800° C. for one hour, withstood 1060.1 N of crushing force.

The cured briquettes of this formula had a density of about 2.21 g/cm$^3$.

EXAMPLE 3

Approximately 83% by weight of lava rock fines were mixed with calcium aluminate 10%, starch 2%, and wood shavings 4%. Water, 1% by weight, was added to the mixture, which was then fed into a briquette roll press, roll torque of 5650 Nm. The formed briquettes were then allowed to dry under ambient conditions.

Briquettes manufactured according to this method demonstrated adequate crushing strength. When "green", a briquette showed 194.8 N of crushing force, with a 1.9-m drop height at failure. After 96 hours of dry curing at ambient temperature, the crushing force was 1045.3 N.

A briquette manufactured according to the forgoing formula of this example, and cured at 800° C. for one hour, withstood 904.4 N of crushing force.

The cured briquettes of this formula had a density of about 2.16 g/cm$^3$.

The preceding examples can be repeated with similar success by substituting the generically or specifically described ingredients and/or operating conditions of this invention for those used in the preceding examples. Particularly, the wood chips generically described preferably are mesquite or hickory wood, and may be chips or small shavings. Briquettes according to the invention containing mesquite or hickory chips will impart the desired smoked or barbeque flavor to the food grilled thereover. However, the wood chips preferably are not compressed pellets or bonded tidbits, which require artificial processing prior to mixing into the briquette dough, and thus increase processing costs without a commensurate increase in beneficial characteristics.

In sum, the overall method of manufacturing the inventive briquettes may be described as follows. First, scoria cobbles are gathered, or scoria rock mined, and then pulverized by any suitable means into lava rock fines comprised of particles no larger than about 1.0 cm, and preferably into particles passing a 300-mesh screen. The briquette dough is then prepared by mixing the ingredients together in conventional industrial mixers. The dough ingredients preferably are between approximately 80 and 90% by weight of scoria fines. Most preferably, between about 5 and about 15% by weight calcium aluminate, and about 3% by weight cornstarch, are mixed with the scoria fines, and then preferably about 2% by weight water is added to the powder mix. Preferably about 3–4% by weight of natural hickory or mesquite shavings (preferably less than about 2.5 cm in length) are mixed into the dough as a flavorizing admixture. The dough mixture is then roll pressed, extruded or otherwise mechanically formed into briquettes of a conventional or other selected size, and allowed to cure or dry. Briquettes may be air-dried under ambient conditions, or alternatively may be heat-dried or cured in a kiln. Dried briquettes may then be packaged for sale.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A briquette, for use with a barbecue grill, comprising:

from about 60 percent to about 95 percent by weight lava rock fines;

from about 5 percent to about 15 percent by weight calcium aluminate;

less than 5 percent by weight starch; and from about 0.2 percent to about 8 percent by weight water.

2. A briquette according to claim 1 comprising from about 80 percent to about 90 percent by weight lava rock fines.

3. A briquette according to claim 1 comprising from about 2 percent to about 4 percent by weight starch.

4. A briquette according to claim 3 wherein said starch comprises cornstarch.

5. A briquette according to claim 1 comprising from about 0.5 percent to about 2 percent by weight water.

6. A man-made briquette, for use with a barbecue grill, comprising:

from about 60 percent to about 95 percent by weight lava rock fines;

from about 5 percent about 15 percent by weight Portland cement;

less than 5 percent by weight starch; and from about 0.2 percent to about 8 percent by weight water.

7. A briquette according to claim 1 comprising from between 1 percent to about 4 percent by weight wood particles.

8. A briquette according to claim 1 wherein said wood particles comprise shavings from the group consisting of hickory and mesquite.

9. A briquette, for use with a barbecue grill, comprising:

from about 60 percent to about 95 percent by weight lava rock fines;

from about 5 percent to about 15 percent by weight of a mixture of calcium aluminate and Portland cement;

less than 5 percent by weight starch; and from about 0.2 percent to about 8 percent by weight water.

10. A briquette according to claim 9 comprising from about 80 percent to about 90 percent by weight lava rock fines.

11. A briquette according to claim 9 comprising from about 2 percent to about 4 percent by weight starch.

12. A briquette according to claim 9 comprising from about 0.5 percent to about 2 percent by weight water.

13. A briquette according to claim 9 further comprising from about 1 percent to about 10 percent by weight wood particles.

14. A briquette according to claim 13 comprising from between 1 percent to about 4 percent by weight wood particles.

15. A briquette, for use with a barbecue grill, comprising:

from about 60 percent to about 95 percent by weight lava rock fines;

from about 5 percent to about 15 percent by weight calcium aluminate;

from about 1 percent to about 10 percent by weight wood particles;

less than 5 percent by weight starch; and from about 0.2 percent to about 8 percent by weight water.

16. A briquette according to claim 15 comprising from about 80 percent to about 90 percent by weight lava rock fines.

17. A briquette according to claim 16 comprising from about 2 percent to about 4 percent by weight starch.

18. A briquette according to claim 17 comprising from about 0.5 percent to about 2 percent by weight water.

19. A briquette according to claim 6 comprising from about 80 percent to about 90 percent by weight lava rock fines.

20. A method of making a briquette for use with a barbecue grill comprising the steps of making a dough by mixing together from about 60 percent to about 95 percent by weight lava rock fines, from about 5 percent to about 15 percent by weight calcium aluminate, less than 5 percent by weight starch, and from about 0.2 percent to about 8 percent by weight waters; and forming the dough into a briquette.

21. A briquette according to claim 19 further comprising from about 1 percent to about 10 percent by weight wood particles.

22. The method of claim 20 wherein the step of forming the dough comprises a step selected from the group consisting of extruding and roll pressing.

23. The method of claim 20 further comprising the step of drying the briquette.

24. The method of claim 20 wherein the step of making a dough comprises mixing from about 80 percent to about 90 percent by weight lava rock fines.

25. The method of claim 20 wherein the step of making a dough comprises mixing from about 2 percent to about 4 percent by weight starch.

26. The method of claim 20 wherein the step of making a dough comprises mixing from about 0.5 percent to about 2 percent by weight water.

27. The method of claim 20 wherein the step of making a dough further comprises mixing from about 1 percent to about 10 percent by weight wood particles.

28. The method of claim 27 wherein the step of making a dough comprises mixing from between 1 percent to about 4 percent by weight wood particles.

29. The method of claim 28 wherein the step of making a dough comprises mixing natural wood shavings.

30. A briquette according to claim 6 comprising from about 0.5 percent to about 2 percent by weight water.

* * * * *